US010539911B1

(12) United States Patent
Imazu

(10) Patent No.: US 10,539,911 B1
(45) Date of Patent: Jan. 21, 2020

(54) FIXING DEVICE AND IMAGE FORMING APPARATUS

(71) Applicant: FUJI XEROX CO., LTD., Tokyo (JP)

(72) Inventor: Koichi Imazu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/294,871

(22) Filed: Mar. 6, 2019

(30) Foreign Application Priority Data

Sep. 20, 2018 (JP) ..... 2018-175969

(51) Int. Cl.
*G03G 15/20* (2006.01)

(52) U.S. Cl.
CPC ..... *G03G 15/2028* (2013.01); *G03G 15/2053* (2013.01)

(58) Field of Classification Search
CPC ..... G03G 15/2028; G03G 15/2053; G03G 15/2064; G03G 2215/2009; G03G 2215/2053
USPC ..... 399/107, 110, 122, 320, 322, 328, 329
See application file for complete search history.

(56) References Cited

U.S. PATENT DOCUMENTS

| | | | | |
|---|---|---|---|---|
| 7,917,074 | B2 | 3/2011 | Takada | |
| 8,249,492 | B2 * | 8/2012 | Matsumoto | G03G 15/2053 399/329 |
| 8,958,733 | B2 | 2/2015 | Nishida et al. | |
| 9,244,409 | B2 * | 1/2016 | Kondo | G03G 15/206 |
| 9,547,263 | B2 * | 1/2017 | Soeda | G03G 15/2053 |

FOREIGN PATENT DOCUMENTS

| | | |
|---|---|---|
| JP | 2009069585 | 4/2009 |
| JP | 2012145633 | 8/2012 |
| JP | 2013218175 | 10/2013 |

* cited by examiner

*Primary Examiner* — Hoan H Tran
(74) *Attorney, Agent, or Firm* — JCIPRNET

(57) ABSTRACT

A fixing device includes a circulating endless belt, a fixing unit that is in contact with the belt to form a fixing nip, a heat source provided on an inner side of the belt or on an inner side of the fixing unit, a pressurizing unit arranged on the inner side of the belt to pressurize the belt against the fixing unit, a sheet interposed between the belt and the pressurizing unit to reduce a sliding resistance, and a restricting unit that restricts movement of the sheet in a direction opposite to a moving direction of the belt at a position near a downstream side of the pressurizing unit in the moving direction of the belt.

9 Claims, 13 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2018-175969 filed Sep. 20, 2018.

BACKGROUND

(i) Technical Field

The present disclosure relates to a fixing device and an image forming apparatus.

(ii) Related Art

As an example of fixing devices, there is a fixing device in which an endless belt is used as a heating member or a pressurizing member and a press contact member that brings the endless belt into press contact with the mating pressurizing or heating member is arranged on an inner side of the endless belt. In this fixing device, a sliding sheet is used for reducing a sliding resistance between the endless belt and the press contact member (Japanese Unexamined Patent Application Publication Nos. 2013-218175, 2012-145633, and 2009-69585).

Japanese Unexamined Patent Application Publication No. 2013-218175 discloses a fixing pressurizing member for use in a fixing part of a fixing device. The fixing pressurizing member includes a sliding sheet having a sliding surface that slides against the inner peripheral surface of a belt of the fixing part, and an elastic member provided on an inner side of the sliding sheet. The sliding sheet is formed of a resin fiber woven fabric, a resin fiber knitted fabric, a resin nonwoven fabric, or a resin film. The elastic member and the sliding sheet are formed by integral molding so that the elastic member is joined to at least an inner side of the sliding surface of the sliding sheet. The sliding surface is a surface having irregularities formed by an irregularity forming process.

Japanese Unexamined Patent Application. Publication No. 2012-145633 discloses a fixing device including a friction reducing sheet arranged between an endless belt and a nip forming member to reduce a sliding resistance when the endless belt travels along with rotation of a pressurizing member. The fixing device is provided with a sheet fixing unit that fixes the friction reducing sheet on its entire side extending in a direction orthogonal to an endless belt traveling direction.

Japanese Unexamined Patent Application Publication No. 2009-69585 discloses a fixing device including a heating part and a pressurizing part in press contact with the heating part to form a fixing nip. At least one of the heating part and the pressurizing part includes an endless fixing belt, a plurality of rollers around which the fixing belt is looped, a pressing member that presses the fixing belt toward the fixing nip from an inner peripheral side near an upstream side of a roller arranged on a downstream side of the fixing nip out of the rollers, a sliding sheet that covers the pressing member, and a restricting member arranged on an outer side of the pressing member at the end of the sliding sheet to restrict slack of the sliding sheet.

SUMMARY

Aspects of non-limiting embodiments of the present disclosure relate to the following case. In a sheet interposed between a belt and a pressurizing unit to reduce a sliding resistance, the occurrence of misalignment of the sheet is reduced when the belt rotates in reverse compared with a case in which the sheet is fixed only at the upstream position of the pressurizing unit in a moving direction of the belt.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device comprising a circulating endless belt, a fixing unit that is in contact with the belt to form a fixing nip, a heat source provided on an inner side of the belt or on an inner side of the fixing unit, a pressurizing unit arranged on the inner side of the belt to pressurize the belt against the fixing unit, a sheet interposed between the belt and the pressurizing unit to reduce a sliding resistance, and a restricting unit that restricts movement of the sheet in a direction opposite to a moving direction of the belt at a position near a downstream side of the pressurizing unit in the moving direction of the belt.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure are described below with reference to the drawings.

First Exemplary Embodiment

Figure 1:
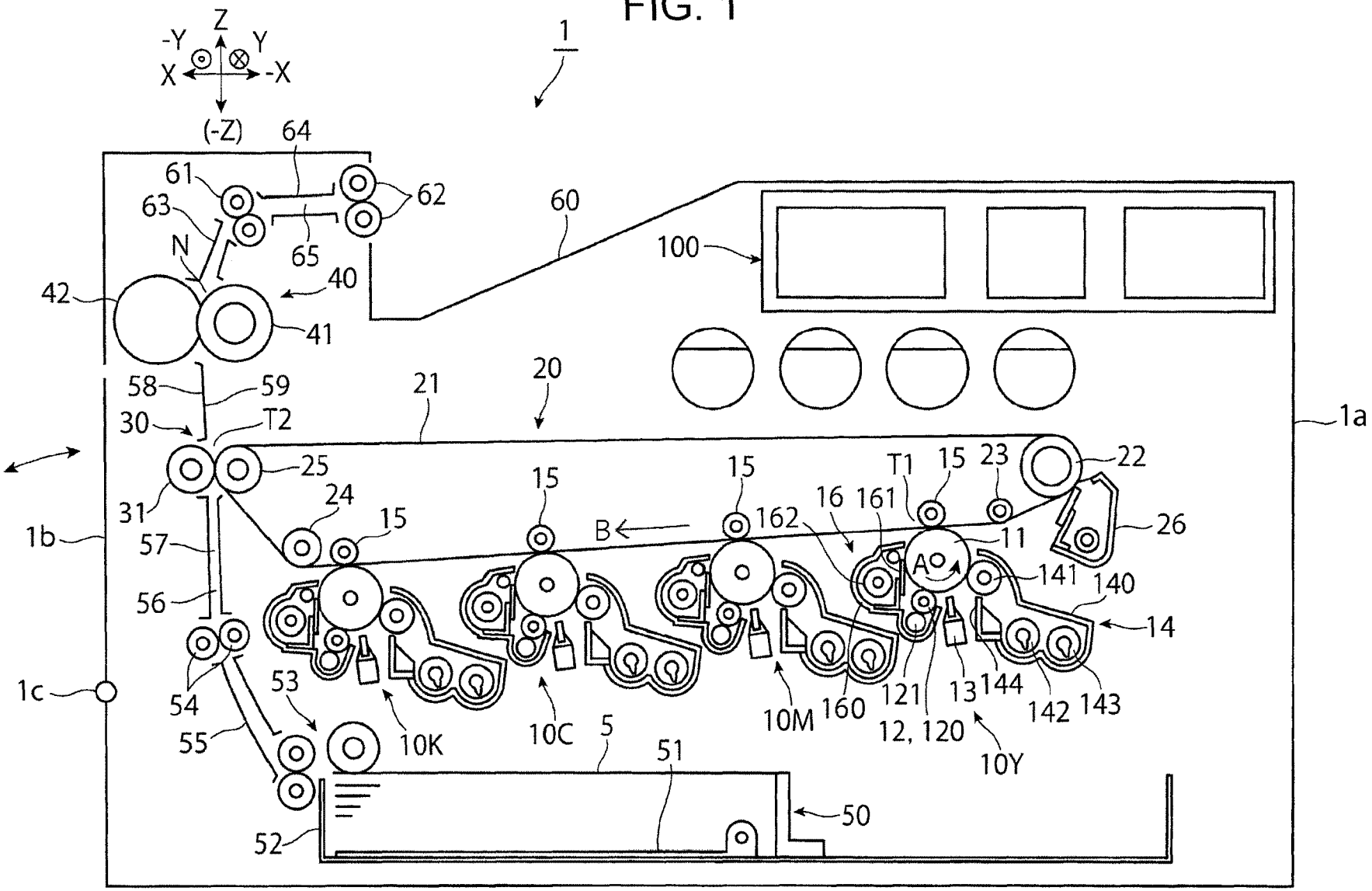
FIG. 1 is a schematic structural view illustrating an image forming apparatus to which a fixing device according to a first exemplary embodiment of the present disclosure is applied.

FIG. 1 schematically illustrates an overall image forming apparatus to which a fixing device according to a first exemplary embodiment is applied. In FIG. 1, an arrow X indicates a width direction along a horizontal plane, an arrow Y indicates a depth direction along the horizontal plane, and an arrow Z indicates a vertical direction.

<Overall Structure of Image Forming Apparatus>

For example, an image forming apparatus 1 is constructed as a color printer. As illustrated in FIG. 1, the image forming apparatus 1 includes a plurality of image forming devices 10 as examples of image forming units that form toner images through development with toner serving as a developer, an intermediate transfer device 20 that carries the toner images formed by the image forming devices 10 and transports the toner images to a second transfer position T2 where the toner images are finally secondly transferred onto recording paper 5 that is an example of a recording medium, a paper feeding device 50 that contains and transports sheets of desired recording paper 5 to be fed to the second transfer position T2 of the intermediate transfer device 20, and a fixing device 40 that fixes the toner images secondly transferred onto the recording paper 5 by the intermediate transfer device 20. Reference symbol 1*a* represents an apparatus body formed of a support structure member, an outside cover, and the like.

The image forming devices 10 are four dedicated image forming devices 10Y, 10M, 10C, and 10K that form toner images of four colors that are yellow (Y), magenta (M), cyan (C), and black (K), respectively. The four image forming devices 10 (Y, M, C, K) are arranged in line while being inclined with respect to the width direction X within an internal space of the apparatus body 1*a*.

As illustrated in FIG. 1, each image forming device 10 (Y, M, C, K) includes a rotary photoconductor drum 11 as an example of an image carrying unit. For example, the following devices are arranged around the photoconductor drum 11. The devices are a charging device 12 that charges the peripheral surface of the photoconductor drum 11 where an image may be formed (image carrying surface) at a desired potential, an exposing device 13 that is an example of an electrostatic latent image forming unit that forms an electrostatic latent image (for each color) with a potential difference by irradiating the charged peripheral surface of the photoconductor drum 11 with light based on image information (signal), a developing device 14 (Y, M, C, K) that is an example of a developing unit that develops the electrostatic latent image into a toner image with toner of a corresponding color (Y, M, C, K) that serves as the developer, a first transfer device 15 that is an example of a first transfer unit that transfers the toner image onto the intermediate transfer device 20, and a drum cleaning device 16 that is an example of a cleaning unit that cleans the image carrying surface of the photoconductor drum 11 after first transfer by removing adherents such as residual toner adhering to the image carrying surface.

The photoconductor drum 11 has an image carrying surface having a photoconductive layer (photosensitive layer) made of a photosensitive material on the peripheral surface of a cylindrical or columnar grounded base. The photoconductor drum 11 is supported so as to rotate in a direction indicated by an arrow A by a driving force transmitted from a driving device (not illustrated).

The charging device 12 includes a contact charging roller 120 arranged in contact with the photoconductor drum 11. The charging roller 120 is supplied with a charging voltage. If the developing device 14 performs reversal development, a voltage or current having a polarity identical to a charging polarity of the toner to be supplied from the developing device 14 is supplied as the charging voltage. On the back of the charging roller 120, a cleaning roller 121 that cleans the surface of the charging roller 120 is arranged in contact with the charging roller 120.

For example, the exposing device 13 includes an LED print head that forms an electrostatic latent image by irradiating the photoconductor drum 11 with light based on image information from a plurality of light emitting diodes (LEDs) serving as light emitting elements arrayed in an axial direction of the photoconductor drum 11. At the time of latent image formation, image information (signal) input to the image forming apparatus 1 by arbitrary means is transmitted to the exposing device 13. As the exposing device 13, there may be used an exposing device that forms an electrostatic latent image by irradiating the charged peripheral surface of the photoconductor drum 11 with laser light obtained based on image information input to the image forming apparatus 1.

As illustrated in FIG. 1, each developing device 14 (Y, M, C, K) is constructed as follows. For example, a developing roller 141 that retains the developer and transports the developer to a developing region where the developing roller 141 faces the photoconductor drum 11, agitating transport members 142 and 143 such as screw augers that transport the developer while agitating the developer so that the developer passes along the developing roller 141, and a layer thickness regulating member 144 that regulates the amount (layer thickness) of the developer to be retained by the developing roller 141 are arranged in a housing 140 having an opening and a chamber containing the developer. A developing voltage is supplied between the developing roller 141 of the developing device 14 and the photoconductor drum 11 from a power supply (not illustrated). The developing roller 141 and the agitating transport members 142 and 143 rotate in desired directions by driving forces transmitted from driving devices (not illustrated). A two-component developer containing non-magnetic toner and a magnetic carrier is used as the developer of each of the four colors (Y, M, C, K).

The first transfer device 15 is a contact transfer device including a first transfer roller that rotates in contact with the peripheral surface of the photoconductor drum 11 via an intermediate transfer belt 21 at a first transfer position T1 and is supplied with a first transfer voltage. As the first transfer voltage, a DC voltage having a polarity opposite to the charging polarity of the toner is supplied from the power supply (not illustrated).

The drum cleaning device 16 is constructed as follows. For example, a cleaning blade 161 that cleans the photoconductor drum 11 by removing adherents such as residual toner and a sending member 162 such as a screw auger that collects the adherents such as the toner removed by the cleaning blade 161 and sends the adherents to a collecting system (not illustrated) are arranged in a container body 160.

The intermediate transfer device 20 is arranged above the image forming devices 10 (Y, M, C, K). For example, the intermediate transfer device 20 includes the intermediate transfer belt 21 that is an example of an intermediate transfer unit that circulates in a direction indicated by an arrow B while passing through each first transfer position T1 between the photoconductor drum 11 and the first transfer device 15 (first transfer roller), a plurality of belt support rollers 22 to 25 that support the intermediate transfer belt 21 in a desired state from the inner periphery so that the intermediate transfer belt 21 may circulate, a second transfer device 30 arranged on an outer peripheral side (image carrying surface) of the intermediate transfer belt 21 supported on the belt support roller 25 to secondly transfer the toner images on the intermediate transfer belt 21 onto the recording paper 5, and a belt cleaning device 26 that cleans the outer peripheral surface of the intermediate transfer belt 21 by removing adherents such as residual toner or paper dust adhering to the outer peripheral surface after the intermediate transfer belt 21 has passed through the second transfer device 30.

As the intermediate transfer belt 21, there is used an endless belt manufactured by using a material obtained by dispersing a resistance regulator such as carbon black in a synthetic resin such as a polyimide resin or a polyamide resin. The belt support roller 22 is a driving roller. The belt support roller 23 is a surfacing roller that keeps the traveling position of the intermediate transfer belt 21. The belt support roller 24 is a tension applying roller. The belt support roller 25 is a second transfer backup roller.

The second transfer device 30 includes a second transfer roller 31 that rotates at the second transfer position T2 that is a portion of the outer peripheral surface of the intermediate transfer belt 21 supported on the belt support roller 25 in the intermediate transfer device 20. A DC voltage having a polarity identical or opposite to the charging polarity of the toner is supplied to the second transfer roller 31 or the belt support roller 25 of the intermediate transfer device 20 as a second transfer voltage.

For example, the fixing device 40 includes a heating roller 41 to be heated by a heating unit so that the surface temperature is kept at a predetermined temperature, and a pressurizing belt 42 that rotates in contact with the heating roller 41 at a desired pressure. In the fixing device 40, a contact part between the heating roller 41 and the pressurizing belt 42 serves as a fixing process part N that performs a desired fixing process (heating and pressurizing). The fixing device 40 is described later in detail.

The paper feeding device 50 is arranged below the image forming devices 10 (Y, M, C, K). For example, the paper feeding device 50 includes a single (or a plurality of) paper container 52 containing sheets of recording paper 5 of a desired size and type that are stacked on a stacking plate 51, and a sending device 53 that sends the sheets of recording paper 5 one by one from the paper container 52. For example, the paper container 52 is drawable at the front of the apparatus body 1*a* (side facing a user during an operation).

Examples of the recording paper 5 include plain paper and thin paper such as tracing paper for use in an electrophotographic copying machine or printer, and an OHP sheet that is a transparent film medium made of a synthetic resin (such as PET). To further improve the smoothness of a fixed image surface, it is desirable that the surface of the recording paper 5 be as smooth as possible. For example, coated paper obtained by coating the surface of plain paper with a resin or the like and so-called thick paper such as art paper for printing whose basis weight is relatively large may be used suitably.

A paper feed path 57 formed of a single (or a plurality of) paper transport roller pair 54 and transport guide members 55 and 56 that transport, to the second transfer position T2, the recording paper 5 sent out from the paper feeding device 50 is provided between the paper feeding device 50 and the second transfer device 30. In the paper feed path 57, the paper transport roller pair 54 arranged immediately upstream of the second transfer position T2 is, for example, a pair of rollers that adjust a timing to transport the recording paper 5 (registration rollers).

A paper transport path 59 formed of, for example, a transport guide member 58 that transports, to the fixing device 40, the recording paper 5 sent out from the second transfer device 30 is provided between the second transfer device 30 and the fixing device 40.

A paper output path 65 including a paper transport roller pair 61, a paper output roller pair 62, and transport guide members 63 and 64 that output the recording paper 5 to which the toner images are fixed by the fixing device 40 to a paper output part 60 arranged at the top of the apparatus body 1*a* is provided on a downstream side of the fixing device 40.

On the left side of the apparatus body 1*a*, a side cover 1*b* with which one paper transport roller out of the paper transport roller pair 54, the transport guide member 56, and the transport guide member 58 are moved to retreat positions when failure in transport of the recording paper 5, that is, a so-called jam has occurred in the paper feed path 57, the paper transport path 59, or the like is provided so as to be openable and closable about a fulcrum 1*c*.

In FIG. 1, reference symbol 100 represents a control device that is an example of a control unit that controls an overall operation of the image forming apparatus 1. Although illustration is omitted, the control device 100 includes a central processing unit (CPU), a read only memory (ROM), a random access memory (RAM), a bus connecting the CPU, the ROM, and the like, and a communication interface.

<Basic Operation of Image Forming Apparatus>

A basic image forming operation to be performed by the image forming apparatus 1 is described below.

Description is made of an image forming operation to be performed when a full-color image that is a combination of four-color (Y, M, C, K) toner images is formed by using the four image forming devices 10 (Y, M, C, K). A basically similar image forming operation is performed also when an image that is a monochrome toner image or a combination of toner images of a plurality of colors is formed by using one or more image forming devices 10 out of the four image forming devices 10 (Y, M, C, K).

When the image forming apparatus 1 has received command information for requesting the image forming operation (printing), the four image forming devices 10 (Y, M, C, K), the intermediate transfer device 20, the second transfer device 30, the fixing device 40, and the like are activated under control of the control device 100.

In each image forming device 10 (Y, M, C, K), the photoconductor drum 11 first rotates in the direction indicated by the arrow A and the charging device 12 charges the surface of the photoconductor drum 11 at a desired polarity (negative polarity in the first exemplary embodiment) and at a desired potential. Then, the exposing device 13 irradiates the charged surface of the photoconductor drum 11 with light emitted based on an image signal obtained such that image information input to the image forming apparatus 1 is converted into each color component (Y, M, C, K). Thus, an electrostatic latent image of each color component is formed on the surface with a desired potential difference.

Then, each developing device 14 (Y, M, C, K) performs development such that toner of a corresponding color (Y, M, C, K) that is charged at a desired polarity (negative polarity) is supplied and electrostatically adheres to the electrostatic latent image of each color component that is formed on the photoconductor drum 11. Through the development, the electrostatic latent image of each color component that is formed on the photoconductor drum 11 is developed into a toner image of each of the four colors (Y, M, C, K) with the toner of the corresponding color.

When the toner images of the respective colors that are formed on the photoconductor drums 11 of the image forming devices 10 (Y, M, C, K) are transported to the first transfer positions T1, the first transfer devices 15 firstly transfer the toner images of the respective colors so as to sequentially superpose the toner images on the intermediate transfer belt 21 of the intermediate transfer device 20 that rotates in the direction indicated by the arrow B.

In each image forming device 10 (Y, M, C, K) that has finished the first transfer, the drum cleaning device 16 cleans the surface of the photoconductor drum 11 by removing adherents in a scraping manner. Thus, the image forming device 10 (Y, M, C, K) is ready for a subsequent image forming operation.

Then, the intermediate transfer device 20 carries the firstly transferred toner images and transports the toner images to the second transfer position T2 through the rotation of the intermediate transfer belt 21. The paper feeding device 50 sends desired recording paper 5 to the paper feed path 57 in synchronization with the image forming operation. In the paper feed path 57, the paper transport roller pair 54 serving as the registration rollers feeds the recording paper 5 to the second transfer position T2 in synchronization with a transfer timing.

At the second transfer position T2, the second transfer roller 31 secondly transfers the toner images on the intermediate transfer belt 21 collectively onto the recording paper 5. In the intermediate transfer device 20 that has finished the second transfer, the belt cleaning device 26 cleans the surface of the intermediate transfer belt 21 by removing adherents such as toner remaining on the surface after the second transfer.

Then, the recording paper 5 where the toner images are secondly transferred is released from the intermediate transfer belt 21 and the second transfer roller 31 and then transported to the fixing device 40 along the paper transport path 59. In the fixing device 40, the unfixed toner images are fixed to the recording paper 5 after the second transfer through a necessary fixing process (heating and pressurizing) by causing the recording paper 5 to enter and pass through the fixing process part N between the rotating heating roller 41 and the rotating pressurizing belt 42. The recording paper 5 after the fixing is output to the paper output part 60 provided at the top of the apparatus body 1*a* via the paper output path 65 by the paper output roller pair 62.

Through the operation described above, a full-color image that is a combination of the toner images formed with four-color toners T (Y, M, C, K) is output.

<Structure of Fixing Device>

Figure 2A:
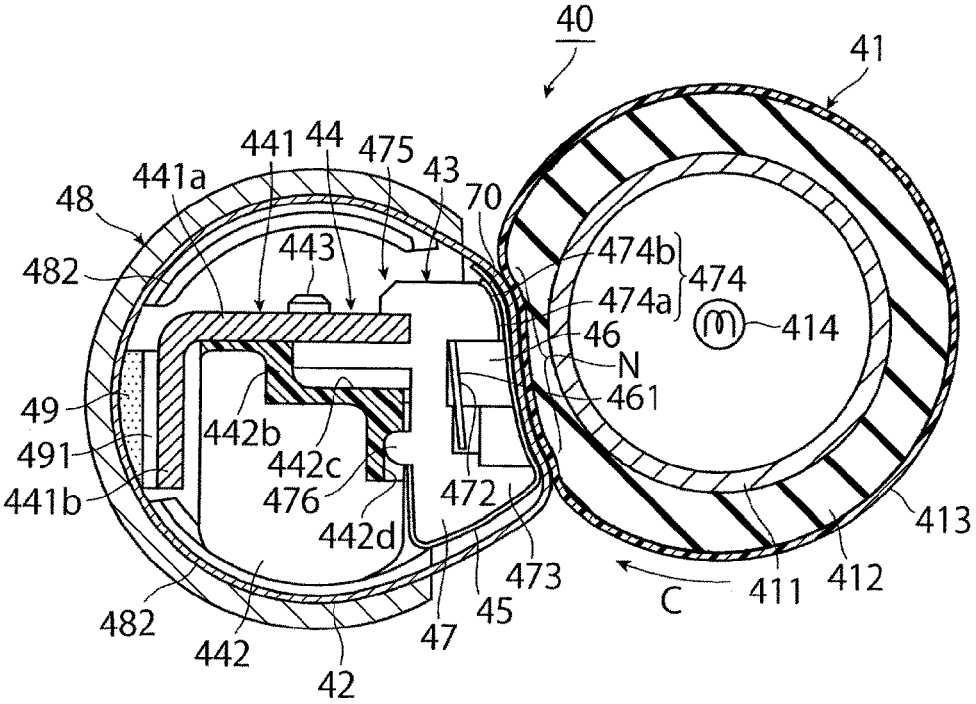
FIGS. 2A and 2B are sectional structural views illustrating the fixing device according to the first exemplary embodiment of the present disclosure.
Figure 2B:
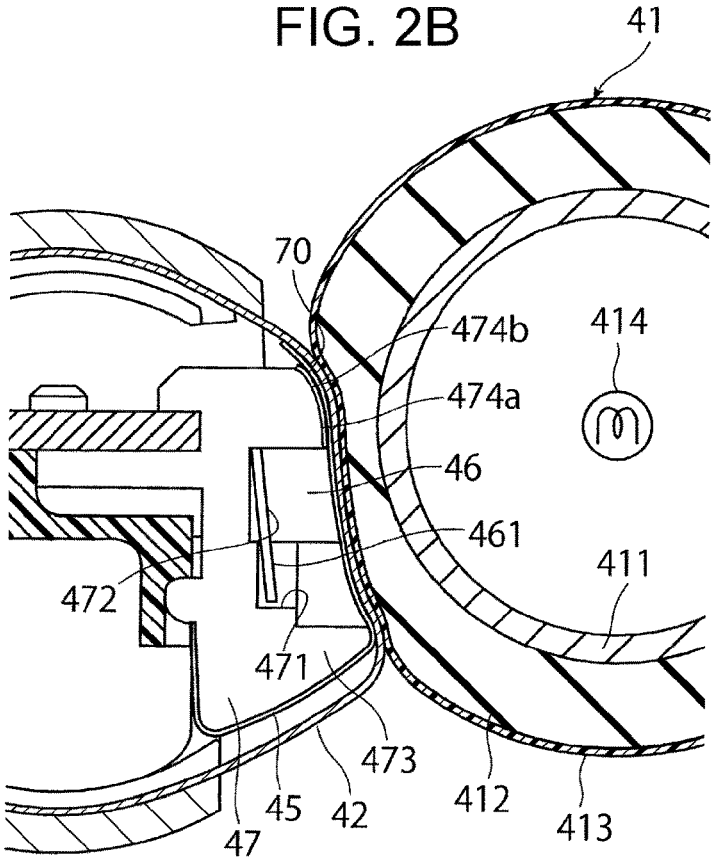
Figure 3:
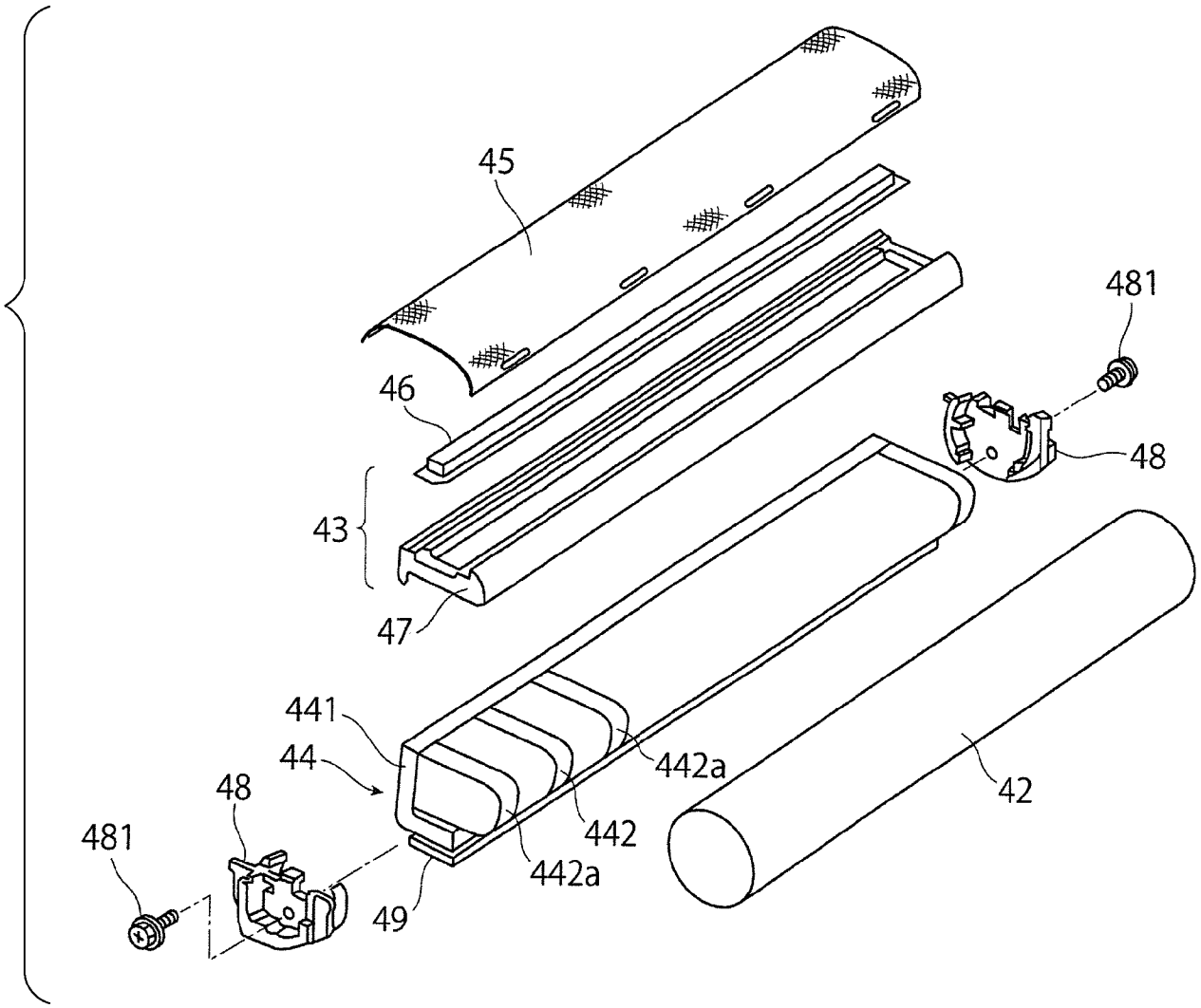
FIG. 3 is an exploded perspective view illustrating the fixing device according to the first exemplary embodiment of the present disclosure.

The fixing device 40 is a so-called free belt nip fixing device. As illustrated in FIG. 2A, FIG. 2B, and FIG. 3, the fixing device 40 roughly includes the heating roller 41 that is an example of a fixing unit, the pressurizing belt 42 that is an example of a circulating endless belt, a pressurizing member 43 that is an example of a pressurizing unit arranged on an inner side of the pressurizing belt 42 to pressurize the pressurizing belt 42 against the surface of the heating roller 41, a holding member 44 that is an example of a holding unit that holds the pressurizing member 43, a sliding sheet 45 that is an example of a sheet interposed between the pressurizing belt 42 and the pressurizing member 43 to reduce a sliding resistance, and a felt member 49 that is an example of a lubricant retaining unit that retains a lubricant to be supplied to the inner peripheral surface of the pressurizing belt 42.

For example, the pressurizing belt 42 is arranged in a housing (not illustrated) of the fixing device 40 in a state in which the position of the pressurizing belt 42 is fixed. The heating roller 41 is urged by an urging unit (not illustrated) in a direction in which the heating roller 41 is in press contact with the pressurizing belt 42 to form the fixing process part N between the heating roller 41 and the pressurizing belt 42.

As illustrated in FIGS. 2A and 2B, the heating roller 41 includes a cylindrical metal core 411 made of a metal such as stainless steel, aluminum, or iron (thin high-tension steel pipe), an elastic layer 412 that coats the outer periphery of the metal core 411 and is made of an elastic body such as silicone rubber or fluorocarbon rubber having a heat resistance, and a thin release layer 413 that coats the surface of the elastic layer 412 and is made of polytetrafluoroethylene (PTFE), perfluoroalkoxy alkane (PFA), or the like. A halogen lamp 414 is arranged in the heating roller 41 as an example of a heat source. The heating roller 41 is driven by a driving device (not illustrated) to rotate in a direction indicated by an arrow C. The heat source need not be provided in the heating roller 41 that is the example of the fixing unit but may be provided in the pressurizing belt 42 that is the example of the belt or in both the heating roller 41 and the pressurizing belt 42.

The surface temperature of the heating roller 41 is detected by a temperature sensor (not illustrated). The heating roller 41 is heated so that its surface has a desired fixing temperature (for example, about 170° C.) by controlling energization of the halogen lamp 414 by using a temperature control circuit (not illustrated) based on a detection result from the temperature sensor.

As illustrated in FIG. 2A, FIG. 2B, and FIG. 3, the pressurizing belt 42 is a thin cylindrical endless belt. The pressurizing belt 42 includes a base layer, an elastic layer that coats the surface of the base layer, and a release layer that coats the surface of the elastic layer. The pressurizing belt 42 may include a base layer and a release layer that directly coats the surface of the base layer. The base layer is made of a synthetic resin such as polyimide, polyamide, or polyamide-imide having a heat resistance, or a metal such as stainless steel, nickel, or copper. The elastic layer is made of an elastic body such as silicone rubber or fluorocarbon rubber having a heat resistance. The release layer is made of polytetrafluoroethylene (PTFE), perfluoroalkoxy alkane (PFA), or the like. For example, the thickness of the pressurizing belt 42 may be set to about 50 to 200 μm.

The pressurizing member 43 that is the example of the pressurizing unit is arranged on the inner side of the pressurizing belt 42. The pressurizing member 43 includes a pressurizing pad 46 that is an example of a first pressing member that pressurizes the pressurizing belt 42 toward the surface of the heating roller 41, and a support member 47 that is an example of a second pressing member having a higher hardness than the pressurizing pad 46.

Figure 4:
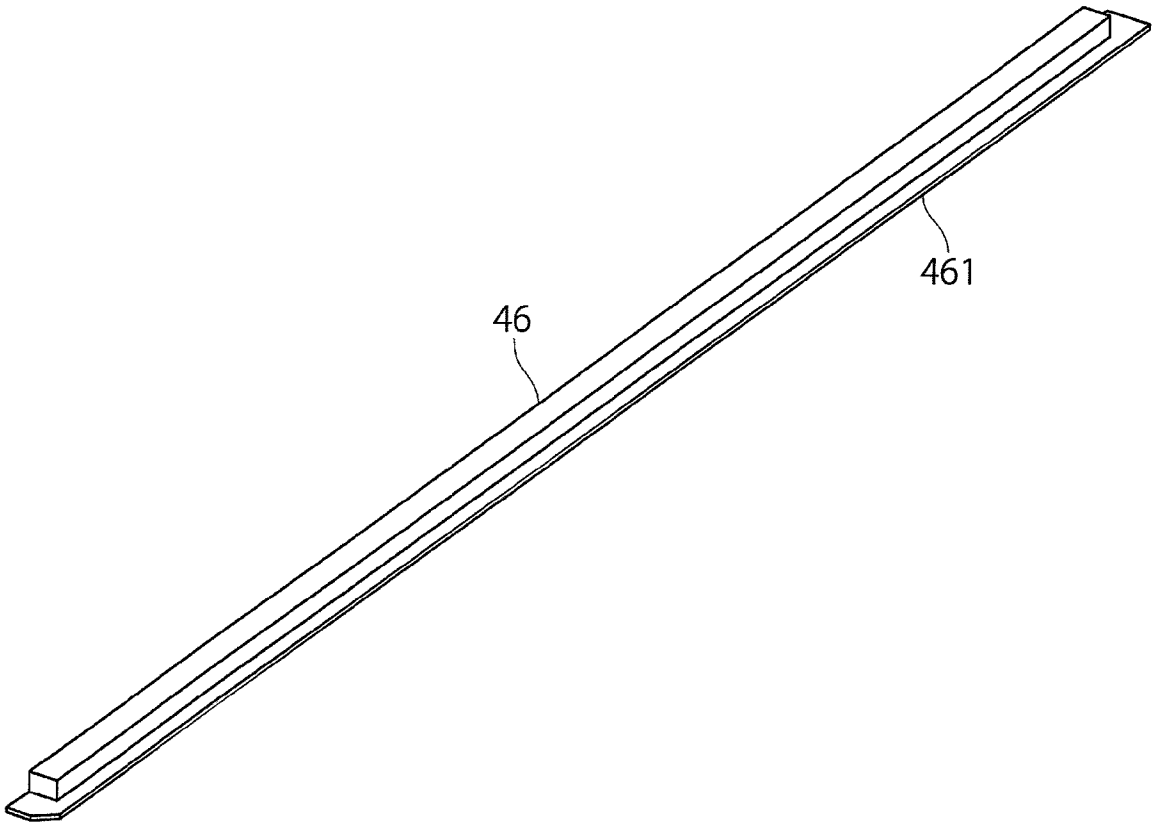
FIG. 4 is a perspective view illustrating a pressurizing pad.

As illustrated in FIG. 4, the pressurizing pad 46 is formed into an elongated rectangular parallelepiped shape that is rectangular in cross section and is made of an elastic body such as silicone rubber or fluorocarbon rubber having a heat resistance. An elongated rectangular plate 461 that is a thin metal plate made of stainless steel or the like is firmly attached to the back of the pressurizing pad 46 by means of bonding or the like on one end side extending in a width direction. The width of the plate 461 is set larger than that of the pressurizing pad 46. The plate 461 supports the pressurizing pad 46 and functions as a positioning member to be used when the pressurizing pad 46 is attached to the support member 47.

The support member 47 has a higher hardness than the pressurizing pad 46 by using, as a material, a synthetic resin such as polyphenylene sulfide (PPS), polyimide, polyester, or polyamide having a heat resistance and a stiffness, or a metal such as iron, aluminum, or stainless steel.

Figure 5:
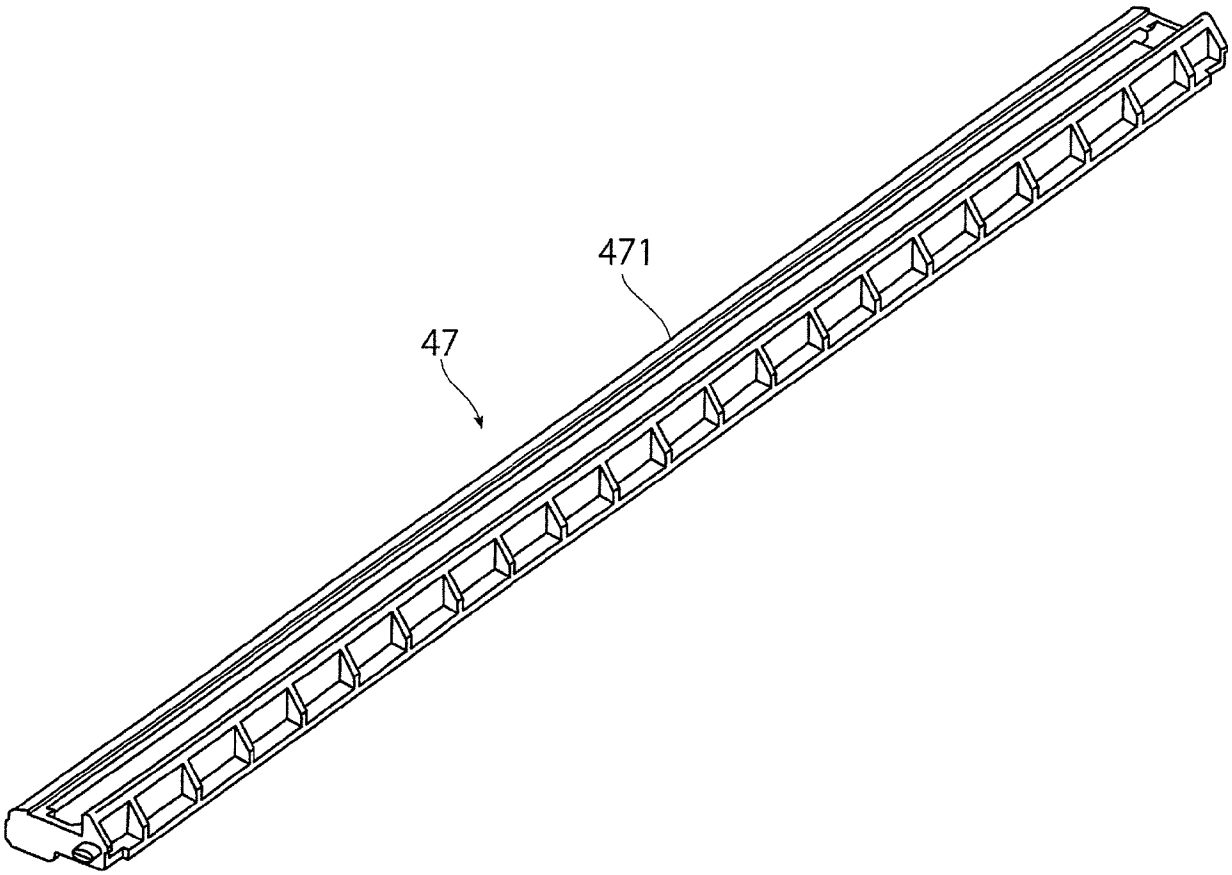
FIG. 5 is a perspective structural view illustrating a support member.
Figure 6:
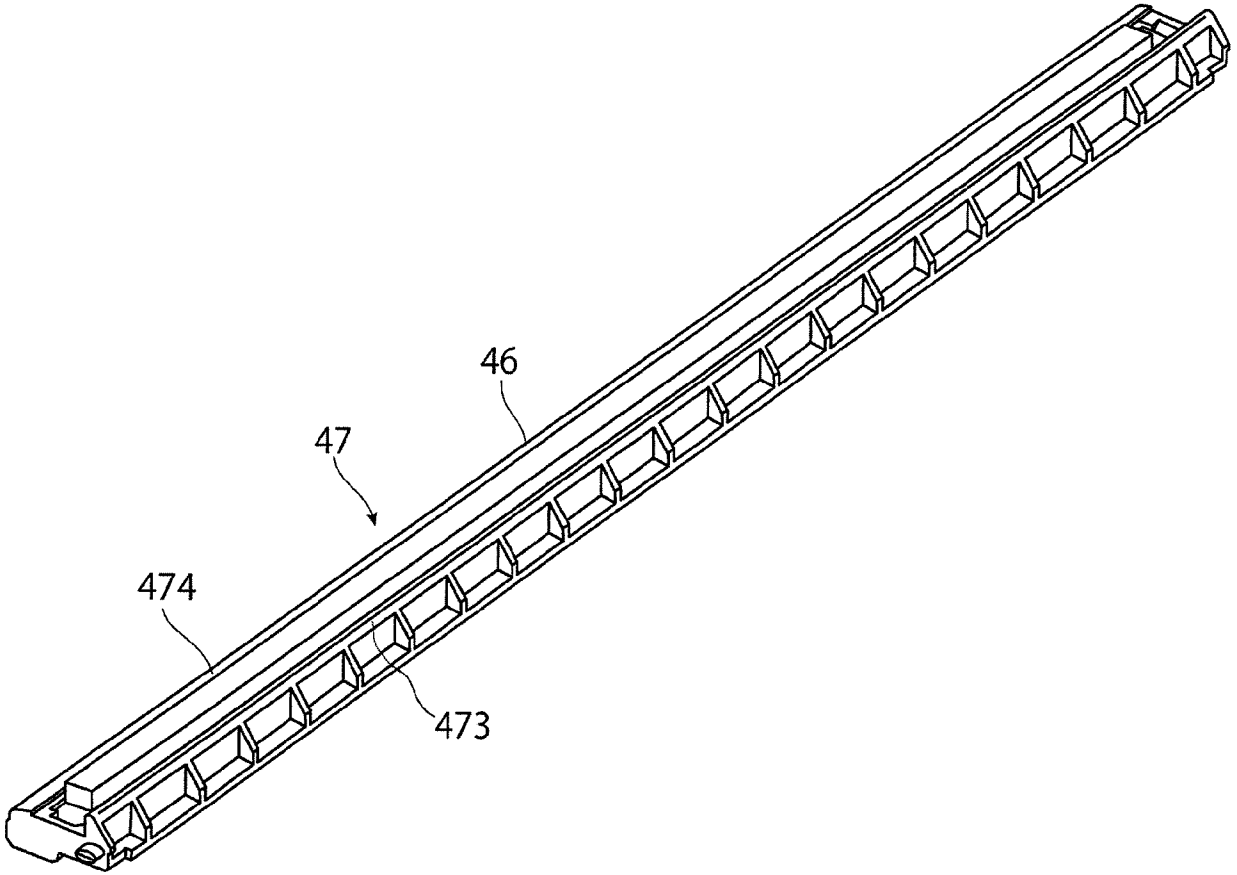
FIG. 6 is a perspective structural view illustrating the pressurizing pad and the support member.

As illustrated in FIG. 5, the support member 47 is formed into an elongated rectangular parallelepiped shape that is substantially rectangular in cross section. On the surface of the support member 47 that faces the heating roller 41, a recess 471 in which the pressurizing pad 46 is received is provided substantially over the total length. As illustrated in FIGS. 2A and 2B, the recess 471 of the support member 47 has a slightly depressed step 472 on a downstream side in a rotating direction of the pressurizing belt 42. As illustrated in FIG. 2A, FIG. 2B, and FIG. 6, the pressurizing pad 46 is inclined in a state in which a downstream portion of the plate 461 in the rotating direction of the pressurizing belt 42 is received in the step 472 so that a downstream portion of the pressurizing pad 46 in the rotating direction of the pressurizing belt 42 is slightly lower in height.

As illustrated in FIGS. 2A and 2B, a guide part 473 that guides the pressurizing belt 42 to the fixing process part N is provided in the support member 47 at the upstream end of the recess 471 in the rotating direction of the pressurizing belt 42. The outer peripheral surface of the guide part 473 is formed into a curved shape.

Figure 7:
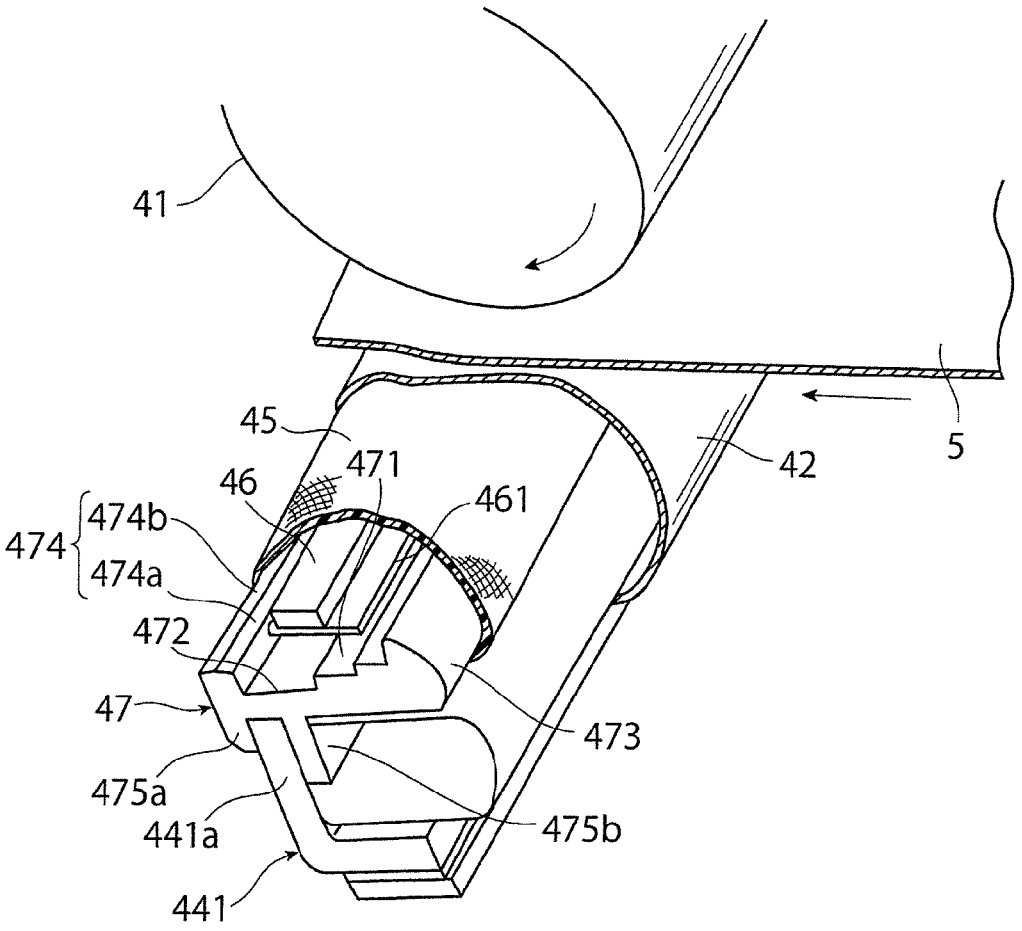
FIG. 7 is a partially cutaway perspective structural view illustrating the fixing device according to the first exemplary embodiment of the present disclosure.

In the support member 47, a release part 474 that releases the recording paper 5 subjected to the fixing process at the fixing process part N is formed at the downstream end of the recess 471 in the rotating direction of the pressurizing belt 42. The release part 474 includes a flat part 474*a* that is a flat surface near the pressurizing pad 46, and an inclined part 474*b* formed on a downstream side of the flat part 474*a* in the rotating direction of the pressurizing belt 42. As illustrated in FIG. 7, the release part 474 brings the pressurizing belt 42 into press contact with the heating roller 41 to deform the elastic layer 412 of the heating roller 41 into a recessed shape, thereby releasing the recording paper 5 that has passed through the fixing process part N from the heating roller 41 owing to the stiffness of the recording paper 5.

Figure 8:
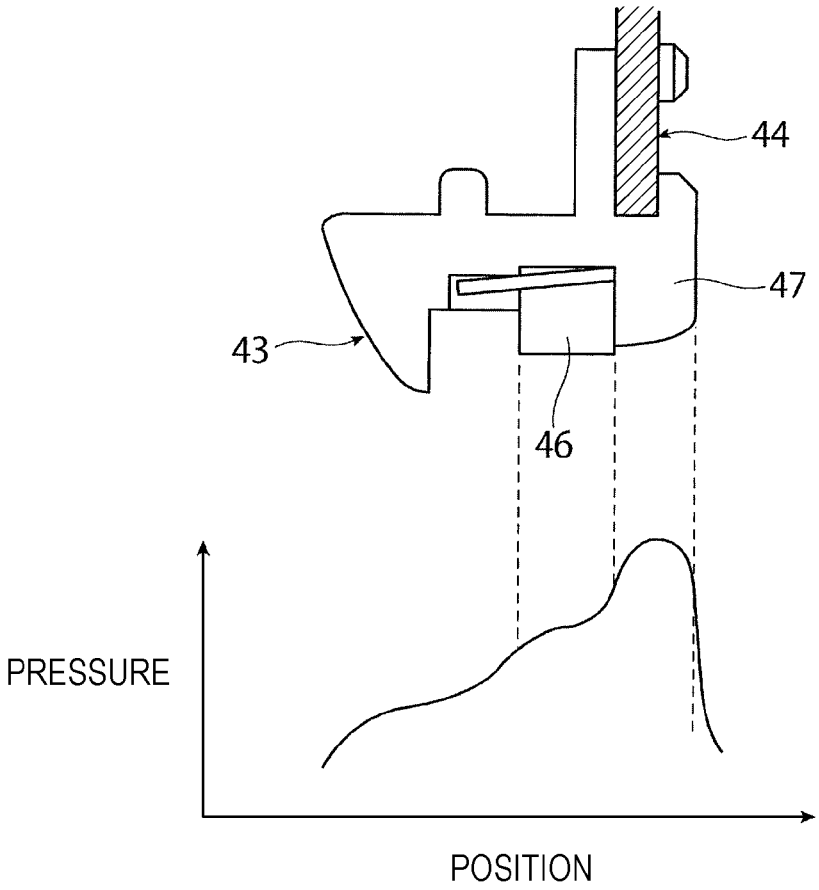
FIG. 8 illustrates pressure distribution at a fixing process part.

The heating roller 41 is in press contact with the pressurizing belt 42 at a desired pressurizing force to form the fixing process part N between the heating roller 41 and the pressurizing belt 42. FIG. 8 illustrates pressure distribution at the fixing process part N. The relative positional relationship between the heating roller 41 and the pressurizing belt 42, the thickness of the elastic layer 412 of the heating roller 41, the protruding amount of the release part 474 of the support member 47, and the like are set so that the pressure is highest in a region corresponding to the release part 474 of the support member 47 and is second highest in a region corresponding to the pressurizing pad 46.

As illustrated in FIGS. 2A and 2B, an attachment part 475 where the support member 47 is attached to the holding member 44 is provided at a portion of the support member 47 that is opposite to the heating roller 41. As illustrated in FIG. 7, the attachment part 475 of the support member 47 includes a short first gripping plate part 475*a* provided at the downstream end in the rotating direction of the pressurizing belt 42 so as to protrude from a surface opposite to the heating roller 41, and a long second gripping plate part 475*b* provided parallel to the first gripping plate part 475*a* so as to protrude from the surface opposite to the heating roller 41.

The attachment part 475 of the support member 47 grips, between the first gripping plate part 475*a* and the second gripping plate part 475*b*, a horizontal plate part 441*a* of a holding plate 441 having an L-shape in cross section in the holding member 44 described later. As necessary, the attachment part 475 is fixed to the holding member 44 by means of bonding or the like.

As illustrated in FIGS. 2A and 2B, a plurality of engagement protrusions 476 that engage with the distal end of the sliding sheet 45 are provided in the attachment part 475 of the support member 47 in a longitudinal direction.

As illustrated in FIGS. 2A and 2B, the holding member 44 holds the pressurizing pad 46 and the support member 47. The pressurizing pad 46 and the support member 47 receive a reaction force from the heating roller 41 because the pressurizing pad 46 and the support member 47 are in press contact with the surface of the heating roller 41. The holding member 44 has a high stiffness so that the holding member 44 is hardly deflected in the longitudinal direction by the reaction force received by the pressurizing pad 46 and the support member 47 from the heating roller 41. The holding member 44 includes the holding plate 441 formed substantially into the L-shape in cross section by drawing or bending a metal such as aluminum or stainless steel, and a holding body 442 fixed to the holding plate 441 in the longitudinal direction and made of, for example, a synthetic resin having a heat resistance.

The holding plate 441 is formed into the L-shape in cross section by the horizontal plate part 441*a* arranged in the horizontal direction and a vertical plate part 441*b* bent downward in the vertical direction at the end of the horizontal plate part 441*a*.

The holding body 442 is attached to the horizontal plate part 441*a* of the holding plate 441 by means of, for example, screwing that uses screws 443 over the total length in the longitudinal direction of the holding plate 441. As illustrated in FIG. 3, the holding body 442 is formed such that a plurality of ribs 442*a* each having a flat-plate shape with a curved end surface opposite to the horizontal plate part 441*a* of the holding plate 441 are arrayed in the longitudinal direction. As indicated by hatching in FIGS. 2A and 2B, the holding body 442 is formed such that the plurality of ribs 442*a* are coupled together by a coupling part 442*b*.

As illustrated in FIGS. 2A and 2B, a recess 442*c* in which the second gripping plate part 475*b* of the support member 47 is received is formed on the upper end surface of each rib 442*a*. A recess 442*d* in which the engagement protrusion 476 of the support member 47 is received is formed on the side surface of the rib 442*a*.

The distal end of the sliding sheet 45 is arranged in a space between the side surfaces of the ribs 442*a* and the side surface of the support member 47.

The holding member 44 only needs to have such material properties and structure that the holding member 44 is hardly deflected in the state in which the pressurizing pad 46 and the support member 47 are in press contact with the heating roller 41. For example, the holding member 44 may be a frame formed into an irregular sectional shape with a large moment of inertia of area by drawing a metal such as aluminum or stainless steel.

As illustrated in FIG. 2A, FIG. 2B, and FIG. 3, support members 48 that rotatably guide and support both longitudinal ends of the pressurizing belt 42 are attached to both longitudinal ends of the holding member 44 by means of, for example, screwing that uses screws 481. The support members 48 include guide parts 482 that are portions of cylinders and rotatably guide and support both longitudinal ends of the pressurizing belt 42.

On the vertical plate part 441*b* of the holding plate 441, the felt member 49 is provided by means of, for example, bonding that uses a double coated tape 491. For example, the felt member 49 is impregnated in advance with about 3 g of the lubricant to be supplied to the inner peripheral surface of the pressurizing belt 42 while being applied thereto. Examples of the lubricant to be used include amino-modified silicone oil having a viscosity of 100 to 350 cs. Although the lubricant is supplied to the inner peripheral surface of the pressurizing belt 42 while being applied thereto by being impregnated into the felt member 49 in advance, the lubricant is not limited thereto and may originally be applied to the inner peripheral surface of the pressurizing belt 42.

Figure 9:
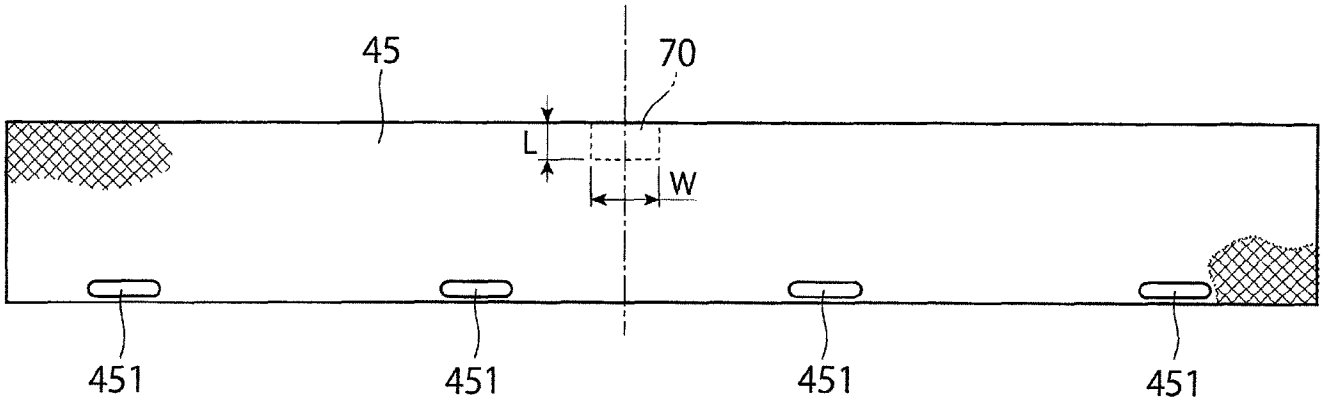
FIG. 9 is a plan view illustrating a sliding sheet.

As illustrated in FIG. 9, the sliding sheet 45 is an elongated sheet that is rectangular in plan view. Examples of the sliding sheet 45 to be used include a sheet including a base layer made of a fluorocarbon resin such as polytetrafluoroethylene (PTFE), and a texture such as a woven fabric or a knitted fabric made of aramid fibers or the like and laminated on the front surface of the base layer or on both front and back surfaces thereof. As the sliding sheet 45, there may be used a sheet including only a base layer made of a fluorocarbon resin such as polytetrafluoroethylene (PTFE). For example, the thickness of the sliding sheet 45 may be set to about 100 to 200 μm.

At the upstream end of the sliding sheet 45 in the rotating direction of the pressurizing belt 42, a plurality of oblong engagement holes 451 are formed in the longitudinal direction. As illustrated in FIGS. 2A and 2B, the sliding sheet 45 is attached such that the plurality of engagement holes 451 engage with the engagement protrusions 476 provided on the side surface of the support member 47. The sliding sheet 45 extends, via the guide part 473 of the support member 47, to the fixing process part N where the pressurizing pad 46 and the heating roller 41 are in press contact with each other. The downstream end of the sliding sheet 45 in the rotating direction of the pressurizing belt 42 extends beyond the release part 474 of the support member 47.

Figure 10:
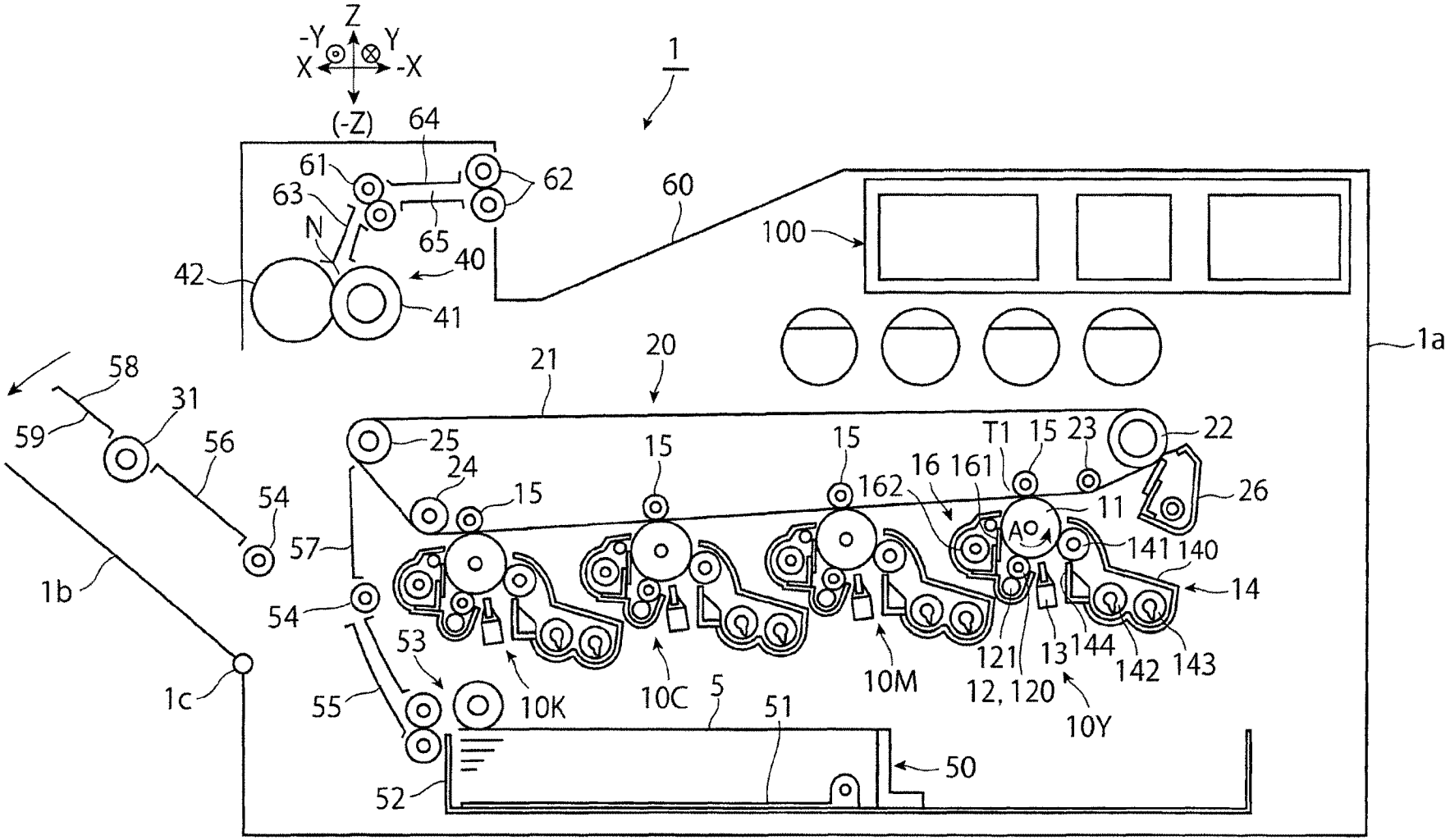
FIG. 10 is a schematic structural view illustrating the image forming apparatus to which the fixing device according to the first exemplary embodiment of the present disclosure is applied.

In the fixing device 40 constructed as described above, failure in transport of the recording paper 5, that is, a so-called jam may occur in the fixing process part N of the fixing device 40. Depending on the position where the jam of the recording paper 5 has occurred, if the leading edge of the recording paper 5 is not exposed to an upper side of the fixing device 40, it is necessary that the side cover 1*b* of the apparatus body 1*a* of the image forming apparatus 1 be opened as illustrated in FIG. 10 to pull the recording paper 5 downward in the vertical direction Z from the fixing device 40.

Figure 11:
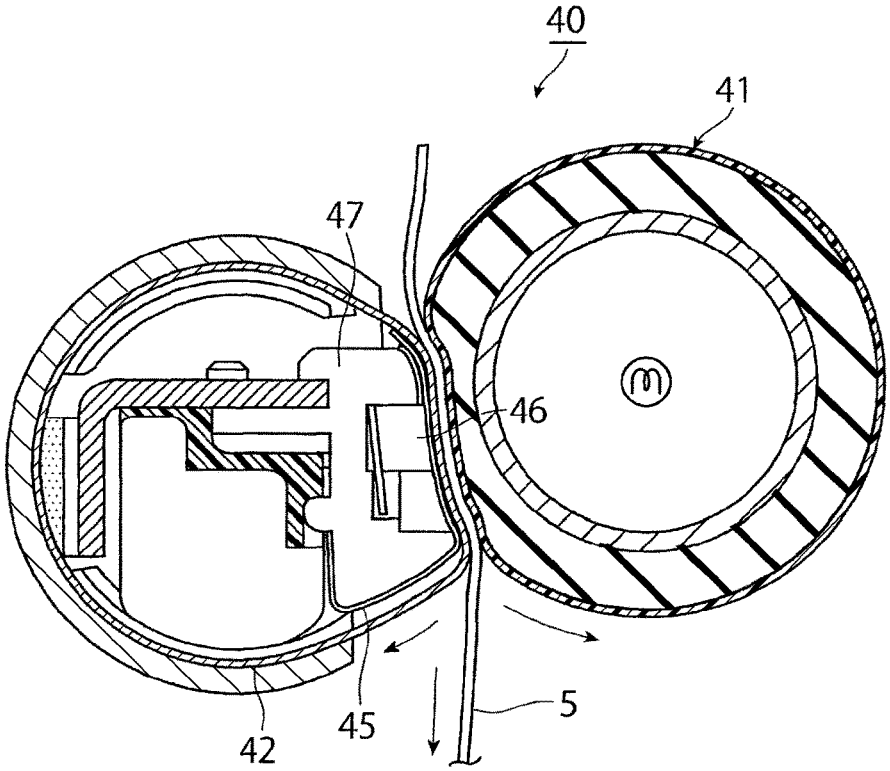
FIG. 11 is a sectional structural view illustrating an operation of the fixing device according to the first exemplary embodiment of the present disclosure.

When the recording paper 5 is pulled downward from the fixing device 40 as illustrated in FIG. 11, the heating roller 41 and the pressurizing belt 42 rotate in directions opposite to those during the fixing. At this time, the sliding sheet 45 interposed between the pressurizing belt 42 and the pressurizing member 43 may move downward in FIG. 11 to cause misalignment along with the rotation of the pressurizing belt 42 in the opposite direction.

When the fixing device 40 resumes the fixing operation by driving the heating roller 41 and the pressurizing belt 42 to rotate after the recording paper 5 causing the jam has been removed, the sliding sheet 45 moves along with the rotation of the pressurizing belt 42 but may be misaligned without returning to the appropriate position.

When the sliding sheet 45 is misaligned, the fixing device 40 has a risk that fixing failure such as uneven fixing or streaks may occur in the recording paper 5 due to irregularities caused by the misalignment of the sliding sheet 45 when the pressurizing belt 42 is driven to rotate.

In this exemplary embodiment, a double coated tape 70 that is an example of a restricting unit that restricts movement of the sliding sheet 45 in a direction opposite to the moving direction of the pressurizing belt 42 is provided at a position near a downstream side of the pressurizing pad 46 in the moving direction of the pressurizing belt 42.

As illustrated in FIG. 2B, the double coated tape 70 is arranged so that the sliding sheet 45 is bonded to a position corresponding to the release part 474 of the support member 47, which is the position near the downstream side of the pressurizing pad 46 in the moving direction of the pressurizing belt 42.

The bonding means that "two objects firmly stick together, do not separate from each other by sticking together, or are caused to stick together." The bonding encompasses adhesion that does not involve exerting a peeling resistance through solidification, as typified by a case in which objects are caused to stick together via an adhesive substance such as a liquid having a high viscosity or the surface of a solid gel.

As the double coated tape 70, it is desirable to use a double coated tape having a thickness of 0.025 mm or smaller in consideration of influence on an image to be fixed onto the recording paper 5 via the sliding sheet 45 and the pressurizing belt 42. Examples of the double coated tape 70 to be used include an optical transparent adhesive sheet having a thickness of 0.025 mm and manufactured by Nitto Denko Corporation in "LUCIACS" (registered trademark) CS986 Series.

As illustrated in FIG. 9, the double coated tape 70 is, for example, arranged only at the center of the sliding sheet 45 in the longitudinal direction that intersects the moving direction of the pressurizing belt 42. For example, a width W of the double coated tape 70 is set to about 5 to 20 mm. For example, a length L of the double coated tape 70 is set to a length corresponding to that of the release part 474 of the support member 47 or a value slightly larger than this length. The values of the width and length of the double coated tape 70 are examples and may be set outside the ranges described above.

Figure 12:
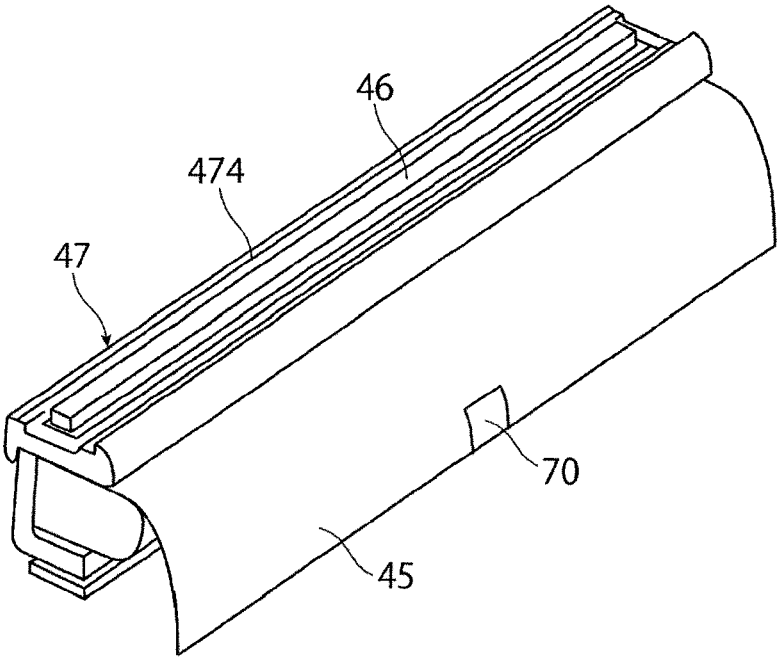
FIG. 12 is a perspective structural view illustrating how the sliding sheet is attached.
Figure 13:
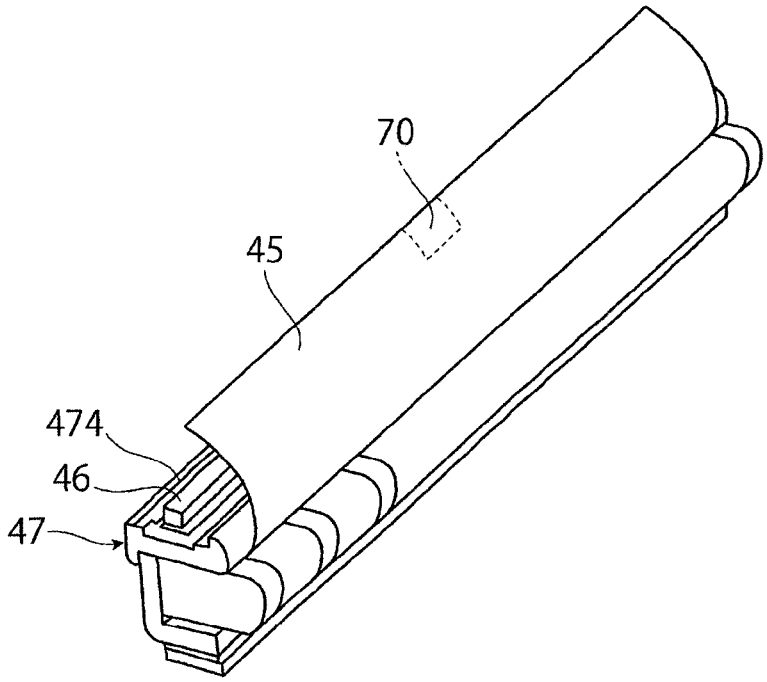
FIG. 13 is a perspective structural view illustrating how the sliding sheet is attached.
Figure 14:
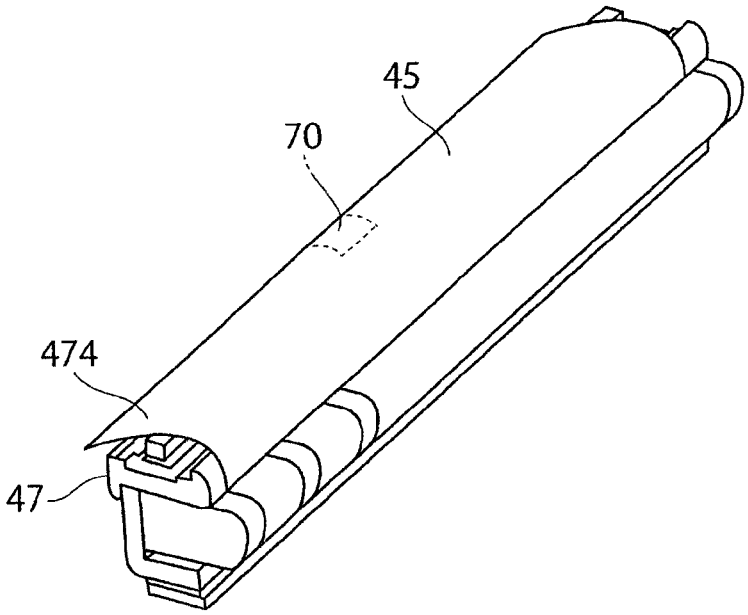
FIG. 14 is a perspective structural view illustrating how the sliding sheet is attached.

As illustrated in FIG. 12, during assembling of the fixing device 40, the double coated tape 70 is bonded to a position that is the center of the sliding sheet 45 in the longitudinal direction and corresponds to the release part 474 of the support member 47 in a state in which a release sheet on one side (not illustrated) is released. As illustrated in FIG. 13, the sliding sheet 45 is then placed around the outer peripheries of the pressurizing pad 46 and the support member 47 in a state in which a release sheet on the other side (not illustrated) of the double coated tape 70 is released. As illustrated in FIG. 14, the proximal end of the sliding sheet 45 is bonded to the release part 474 of the support member 47.

<Operation of Fixing Device>

In the fixing device 40 according to the first exemplary embodiment, the recording paper 5 where unfixed toner images are formed is heated and pressurized through the fixing process part N where the heating roller 41 and the pressurizing belt 42 are in press contact with each other, thereby fixing the unfixed toner images onto the recording paper 5.

In the fixing device 40, failure in transport of the recording paper 5, that is, a so-called jam may occur in the fixing process part N of the fixing device 40. At this time, it is necessary that the side cover 1*b* of the apparatus body 1*a* of the image forming apparatus 1 be opened as illustrated in FIG. 10 to expose the upstream end of the recording paper 5 in the transport direction and pull the recording paper 5 downward in the vertical direction Z from the fixing device 40.

When the recording paper 5 is pulled downward from the fixing device 40 as illustrated in FIG. 11, the heating roller 41 and the pressurizing belt 42 rotate in directions opposite to those during the fixing. At this time, the sliding sheet 45 interposed between the pressurizing belt 42 and the pressurizing member 43 may move downward in FIG. 11 to cause misalignment along with the rotation of the pressurizing belt 42 in the opposite direction.

In the fixing device 40 according to the first exemplary embodiment, as illustrated in FIG. 2B, the downstream end of the sliding sheet 45 in the rotating direction of the pressurizing belt 42 is bonded to the release part 474 of the support member 47 via the double coated tape 70. Even if the heating roller 41 and the pressurizing belt 42 rotate in the directions opposite to those during the fixing when the recording paper 5 is pulled downward, the occurrence of misalignment is prevented or reduced because the downstream end of the sliding sheet 45 is bonded to the release part 474 of the support member 47 via the double coated tape 70.

When the fixing device 40 resumes the fixing operation by driving the heating roller 41 and the pressurizing belt 42 to rotate after the recording paper 5 causing the jam has been removed, the occurrence of misalignment of the sliding sheet 45 may be reduced to avoid the risk that the fixing failure such as uneven fixing or streaks may occur in the toner images to be fixed to the recording paper 5.

Second Exemplary Embodiment

Figure 15:
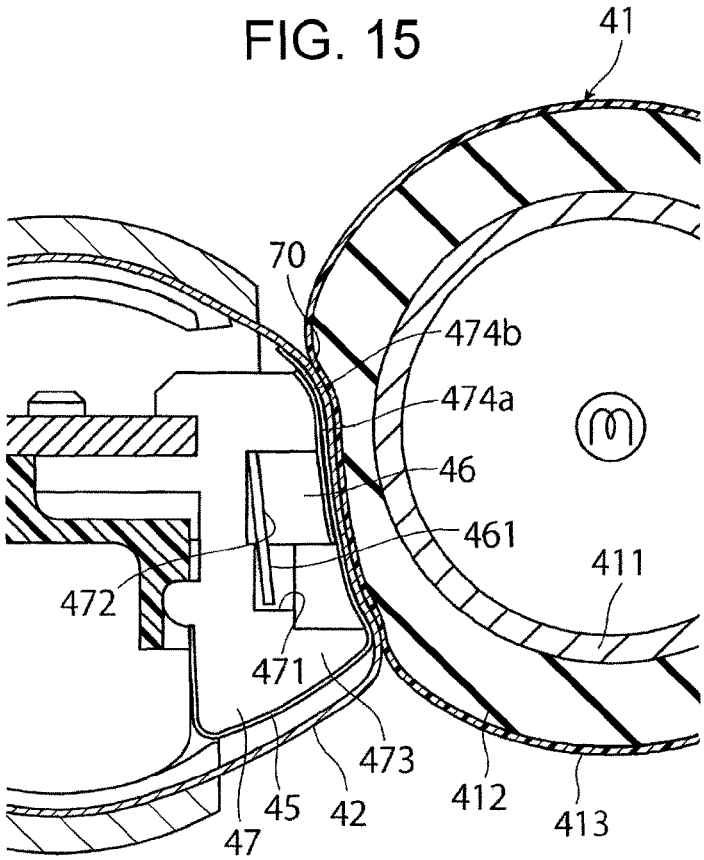
FIG. 15 is a sectional structural view illustrating a principal part of a fixing device according to a second exemplary embodiment of the present disclosure.

FIG. 15 is a structural view illustrating a fixing device according to a second exemplary embodiment. In the fixing device 40 according to the second exemplary embodiment, the restricting unit restricts the movement of the sheet at both a support unit and the pressurizing unit.

That is, in the fixing device 40 according to the second exemplary embodiment, as illustrated in FIG. 15, the proximal end of the sliding sheet 45 in the rotating direction of the pressurizing belt 42 is bonded to both the release part 474 of the support member 47 and the pressurizing pad 46 with the double coated tape 70.

In the fixing device 40 according to the second exemplary embodiment, the contact area of the sliding sheet 45 may be increased and the misalignment of the sliding sheet 45 may be prevented or reduced more securely because the proximal end of the sliding sheet 45 in the rotating direction of the pressurizing belt 42 is bonded to both the release part 474 of the support member 47 and the pressurizing pad 46 with the double coated tape 70.

Third Exemplary Embodiment

Figure 16:
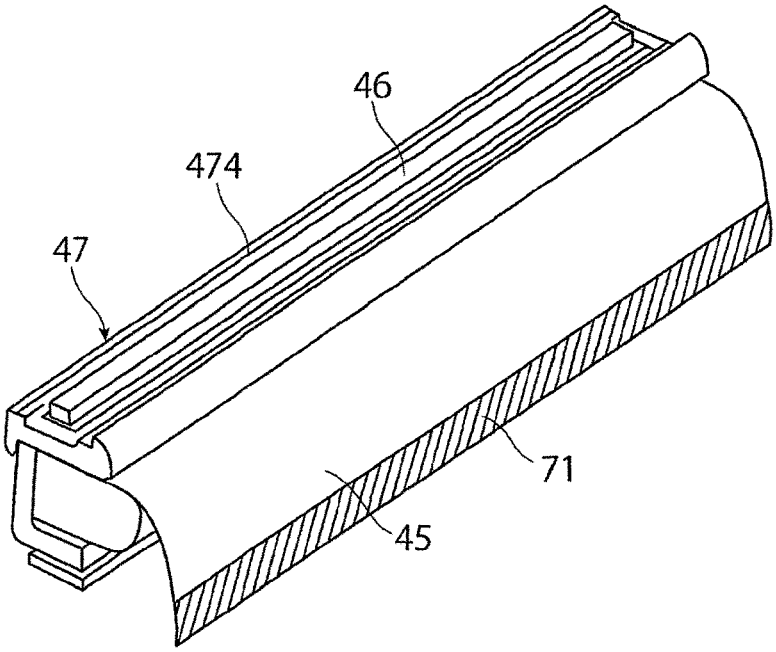
FIG. 16 is a perspective structural view illustrating a principal part of a fixing device according to a third exemplary embodiment of the present disclosure.

FIG. 16 is a structural view illustrating a fixing device according to a third exemplary embodiment. In the fixing device 40 according to the third exemplary embodiment, the sheet is boned over the total length of the support unit in the longitudinal direction by the restricting unit.

That is, in the fixing device 40 according to the third exemplary embodiment, as illustrated in FIG. 16, the proximal end of the sliding sheet 45 in the rotating direction of the pressurizing belt 42 is bonded to the support member 47 such that an adhesive layer 71 in which an adhesive is applied in a band shape over the total length of the sliding sheet 45 in the longitudinal direction is provided at the proximal end of the sliding sheet 45 in the rotating direction of the pressurizing belt 42.

The adhesive layer 71 in which the adhesive is applied in the band shape is curable with its thickness greatly reduced compared with the double coated tape 70. Thus, the influence on the image to be fixed may further be reduced.

In the exemplary embodiments described above, the color image forming apparatus including the yellow (Y), magenta (M), cyan (C), and black (K) image forming devices is described as the image forming apparatus. A monochrome image forming apparatus is similarly applicable as the image forming apparatus.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device, comprising:

a circulating endless belt;

a fixing unit that is in contact with the belt to form a fixing nip;

a heat source provided on an inner side of the belt or on an inner side of the fixing unit;

a pressurizing unit arranged on the inner side of the belt to pressurize the belt against the fixing unit;

a sheet interposed between the belt and the pressurizing unit to reduce a sliding resistance; and a restricting unit that restricts movement of the sheet in a direction opposite to a moving direction of the belt at a position near a downstream side of the pressurizing unit in the moving direction of the belt.

2. The fixing device according to claim 1, wherein the restricting unit bonds the sheet to the position near the downstream side of the pressurizing unit in the moving direction of the belt.

3. The fixing device according to claim 2, wherein the restricting unit is arranged only at a center of the sheet in a direction that intersects the moving direction of the belt.

4. The fixing device according to claim 3, wherein a thickness of a bonding layer of the restricting unit is 0.025 mm or smaller.

5. The fixing device according to claim 1, wherein a pressurizing force of the pressurizing unit is maximum at the position near the downstream side of the pressurizing unit in the moving direction of the belt.

6. The fixing device according to claim 5, wherein the pressurizing unit comprises a first pressing member and a second pressing member having a higher hardness than the first pressing member, and wherein the restricting unit is provided on the second pressing member.

7. The fixing device according to claim 6, wherein the restricting unit restricts the movement of the sheet at both the first pressing member and the second pressing member of the pressurizing unit.

8. An image forming apparatus, comprising:

an image forming unit that forms an unfixed toner image on a recording medium; and a fixing device that fixes the unfixed toner image formed on the recording medium, wherein the fixing device comprises the fixing device according to claim 1.

9. A fixing device, comprising:

a circulating endless belt;

fixing means that is in contact with the belt to form a fixing nip;

a heat source provided on an inner side of the belt or on an inner side of the fixing means;

pressurizing means arranged on the inner side of the belt to pressurize the belt against the fixing means;

a sheet interposed between the belt and the pressurizing means to reduce a sliding resistance; and restricting means for restricting movement of the sheet in a direction opposite to a moving direction of the belt at a position near a downstream side of the pressurizing means in the moving direction of the belt.

* * * * *